US007898534B2

(12) United States Patent
Yonemochi

(10) Patent No.: US 7,898,534 B2
(45) Date of Patent: Mar. 1, 2011

(54) ELECTRO-OPTICAL APPARATUS, METHOD FOR DRIVING ELECTRO-OPTICAL APPARATUS, METHOD FOR MONITORING VOLTAGE, AND ELECTRONIC DEVICE

(75) Inventor: Akihiko Yonemochi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1155 days.

(21) Appl. No.: 11/555,514

(22) Filed: Nov. 1, 2006

(65) Prior Publication Data

US 2007/0115239 A1 May 24, 2007

(30) Foreign Application Priority Data

Nov. 21, 2005 (JP) ..... 2005-336130
Aug. 28, 2006 (JP) ..... 2006-231065

(51) Int. Cl.
*G09G 5/00* (2006.01)

(52) U.S. Cl. ..... 345/204

(58) Field of Classification Search ..... 345/87–100, 345/204, 690

See application file for complete search history.

(56) References Cited

U.S. PATENT DOCUMENTS 5,113,134 A * 5/1992 Plus et al. ..... 324/770
5,608,558 A * 3/1997 Katsumi ..... 349/192
5,841,411 A * 11/1998 Francis ..... 345/58
6,265,889 B1 * 7/2001 Tomita et al. ..... 324/765
6,590,553 B1 * 7/2003 Kimura et al. ..... 345/92
6,943,765 B2 * 9/2005 Aoki ..... 345/94
6,985,003 B2 * 1/2006 Li et al. ..... 324/770
7,315,314 B2 * 1/2008 Sagano et al. ..... 345/690
7,705,818 B2 * 4/2010 Aoki et al. ..... 345/98
2002/0067326 A1 * 6/2002 Aoki ..... 345/89
2002/0140650 A1 * 10/2002 Kai et al. ..... 345/87
2003/0043097 A1 * 3/2003 Shingai et al. ..... 345/87
2005/0219161 A1 * 10/2005 Aoki ..... 345/67
2005/0237291 A1 * 10/2005 Aoki ..... 345/100

FOREIGN PATENT DOCUMENTS

JP A 2004-177930 6/2004

* cited by examiner

*Primary Examiner* — Sumati Lefkowitz
*Assistant Examiner* — Rodney Amadiz
(74) *Attorney, Agent, or Firm* — Oliff & Berridge, PLC

(57) ABSTRACT

An electro-optical apparatus includes scanning lines, data lines, and pixels in a pixel area, virtually divided into different regions. The electro-optical apparatus further includes a scanning-line driving circuit including a shift register, the scanning-line driving circuit selecting a scanning line included in one of the regions and then selecting a scanning line included in the other region, a block selection circuit for sequentially selecting a block composed of the data lines for m columns, a data-signal supplying circuit for supplying respective data signals having voltages according to grayscales of pixels, a sampling switch sampling the data signals, and a voltage measuring circuit for measuring a voltage of a data signal supplied to at least one of the m image signal lines in a period from a rising of the transfer start pulse to a supply of an image signal corresponding to the scanning line at a first row.

7 Claims, 13 Drawing Sheets

ELECTRO-OPTICAL APPARATUS, METHOD FOR DRIVING ELECTRO-OPTICAL APPARATUS, METHOD FOR MONITORING VOLTAGE, AND ELECTRONIC DEVICE

BACKGROUND

1. Technical Field

The present invention relates to a technique for improving display quality in so-called region scan driving.

2. Related Art

Projectors that form images by using electrooptic characteristics of liquid crystal or other known materials and project the enlarged images by means of optical systems are becoming popular. A small display panel of such a projector has very narrow gaps between pixels, and thus so-called disclination (alignment defect) is a problem. The disclinatlon can be avoided by using a field inversion (also called a frame inversion) scheme, in which adjacent pixels have the same polarity. However, the field inversion scheme has a problem in which display is inconsistent between, for example, upper and lower regions of a display screen.

One approach to maintaining display consistency is disclosed in JP-A-2004-177930. In this approach, a frame period is divided into, for example, first and second periods, and a display region is divided into upper (first) and lower (second) regions. The upper and lower regions are alternately selected, and in the selected region, scanning lines are selected from top to bottom. During the first period, the upper region has positive polarity and the lower region has negative polarity, whereas, during the second period, the upper region has the negative polarity and the lower region has positive polarity. This approach is so-called region scan driving.

A projector of the above-described type itself does not have a function of generating an image. Therefore, the projector receives image data (or an image signal) supplied from a host system (e.g., a personal computer or television tuner). The image data specifies a gray scale (brightness) of a pixel for each pixel and is supplied in such a way that a matrix of pixels is scanned vertically and horizontally.

However, for the region scan driving, since the upper and lower regions are alternately selected in a continuous manner, no blanking period is present in vertical scanning of a display panel. Therefore, the region scan driving has a problem in which it is difficult to perform processing using a blanking period, for example, processing for improving display quality.

SUMMARY

An advantage of some aspects of the invention is that it provides an electro-optical apparatus capable of producing a period corresponding to a blanking period in so-called region scan driving and performing necessary processing in this period, a method for driving an electro-optical apparatus, a method for monitoring a voltage, and an electronic device.

According to a first aspect of the invention, an electro-optical apparatus includes a plurality of rows of scanning lines, a plurality of columns of data lines, and a plurality of pixels disposed so as to correspond to intersections of the plurality of rows of scanning lines and the plurality of columns of data lines. The scanning lines, the data lines, and the pixels are disposed in a pixel area, and the pixel area is virtually divided into at least first and second regions along the scanning lines. The electro-optical apparatus further includes a scanning-line driving circuit including a shift register for sequentially shifting a transfer start pulse, the scanning-line driving circuit selecting a scanning line included in one of the first and second regions and then selecting a scanning line included in the other one of the first and second regions, a block selection circuit for sequentially selecting a block composed of the data lines for m columns (m is an integer that is larger than one and smaller than the number of the data lines) when the scanning line is selected, a data-signal supplying circuit for supplying to m image signal lines respective data signals having voltages according to grayscales of pixels corresponding to the selected scanning line and the data lines for the m columns belonging to the selected block, a sampling switch disposed on each of the data lines, the sampling switch sampling the data signals supplied to the m image signal lines into the data lines for the m column belonging to the selected block selected by the block selection circuit, and a voltage measuring circuit for measuring a voltage of a data signal supplied to at least one of the m image signal lines in a period from a rising of the transfer start pulse to a supply of an image signal corresponding to the scanning line at a first row.

It is preferable that the voltage measuring circuit adjust a measured voltage of a data signal supplied from the data-signal supplying circuit so that the measured voltage of the data signal is equal to a predetermined target value.

It is preferable that the electro-optical apparatus further include a detection circuit. Preferably, the scanning-line driving circuit may include a shift register for sequentially shifting a transfer start pulse DY with a clock signal CLY and a logic circuit disposed so as to correspond to each of the plurality of scanning lines, each of the logic circuits receiving either one of first and second enable signals, reducing a pulse width of a shift signal output from the shift register to a pulse width of the received first or second enable signal, and supplying the signal to the corresponding scanning line as a scan signal Preferably, the logic circuit for receiving the first enable signal and the logic circuit for receiving the second enable signal may be alternately disposed, the block selection circuit may include a shift register for sequentially shifting a transfer start pulse DX with a clock signal CLX, and the detection circuit detects that the transfer start pulse DY, either one of the first and second enable signals, and the transfer start signal DX may satisfy a predetermined condition and permits the voltage measuring circuit to measure the voltage.

It is preferable that the detection circuit may detect the predetermined condition in such a way that the transfer start pulse DY and either one of the first and second enable signals is switchable.

According to a second aspect of the invention, an electro-optical apparatus includes a plurality of pixels disposed in a pixel area so as to correspond to intersections of a plurality of rows of scanning lines and a plurality of columns of data lines, the pixels indicating grayscales according to voltages of data signals supplied to the data lines, the pixel area being virtually divided into at least first and second regions along the scanning lines, a scanning-line driving circuit exclusively selecting the scanning lines at established intervals so that the selection moves toward a predetermined direction, wherein the scanning-line driving circuit selects the scanning lines in different manners for first and second cases; for the first case, after selecting scanning lines in one of the first and second regions, the scanning-line driving circuit selects scanning lines in the other one of the first and second regions; and for the second case, after selecting scanning lines in one regions of the first and second regions, the scanning-line driving circuit selects scanning lines adjacent to the selected scanning lines in the predetermined direction, a block selection circuit for sequentially selecting a block composed of the data lines for m columns (m is an integer that is larger than one and smaller than the number of the data lines) when the scanning lines are selected, a data-signal supplying circuit for supplying to m image signal lines respective data signals having voltages according to grayscales of pixels corresponding to the selected scanning lines and the data lines for the m columns belonging to the selected block, a sampling switch disposed on each of the data lines, the sampling switch sampling the data signals supplied to the m image signal lines into the data lines for the m column belonging to the selected block selected by the block selection circuit, and a voltage measuring circuit for measuring a voltage of a data signal supplied to at least one of the m image signal lines when none of the plurality of scanning lines is selected in the second case. According to the second aspect, for the second case, a period over which none of the plurality of scanning lines is selected can be designated as a period corresponding to a blacking period in region scan driving, and necessary processing, specifically, processing for measuring the voltage of a data signal can be performed in this period.

According to a further aspect of the invention, in addition to an electro-optical apparatus, a method for driving the electro-optical apparatus, a method for monitoring a voltage of a data signal in the electro-optical apparatus, and an electronic device including the electro-optical apparatus can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
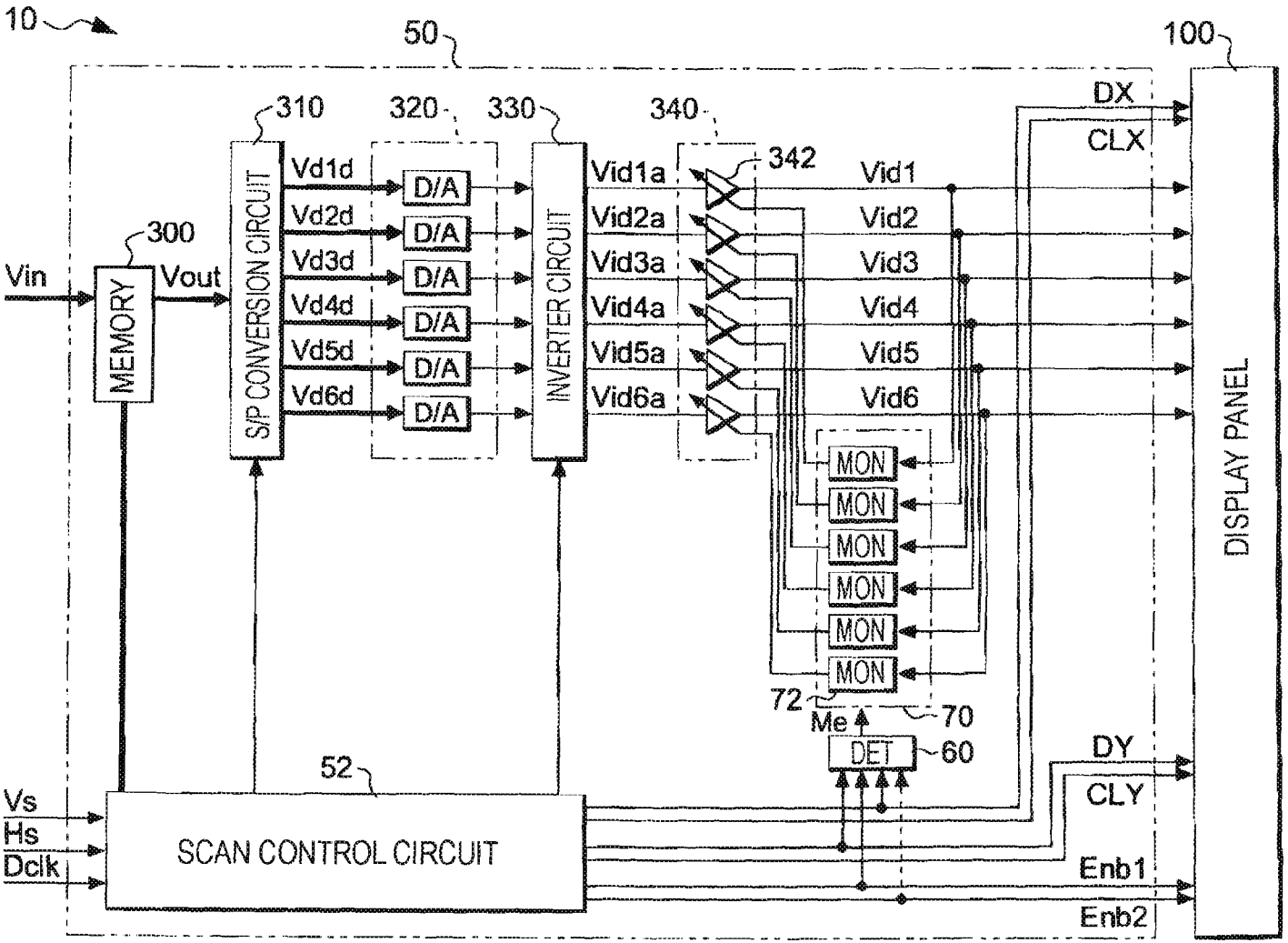
FIG. 1 is a block diagram illustrating a general structure of an electro-optical apparatus according to an embodiment of the invention.

Embodiments of the invention are described with reference to the drawings. FIG. 1 is a block diagram illustrating a general structure of an electro-optical apparatus according to an embodiment of the invention.

As illustrated in FIG. 1, an electro-optical apparatus 10 has two main portions, i.e., a processing circuit 50 and a display panel 100. The processing circuit 50 is a circuit module formed on a printed board and is connected to the display panel 100 via a flexible printed circuit (FPC) or other known boards.

The processing circuit 50 includes a memory 300, a serial/parallel (S/P) conversion circuit 310, digital/analog (D/A) conversion circuitry 320, an inverter circuit 330, amplifier circuitry 340, a scan control circuit 52, a detection circuit 60, and voltage measuring circuits 70.

The memory 300 temporarily stores (writes) image data Vin supplied from a host system (not shown) on the basis of control of the scan control circuit 52 and then reads it as image data Volt. Each of the image data Vin and the image data Vout is data that specifies a gray scale (brightness) of a pixel for each pixel.

Figure 2:
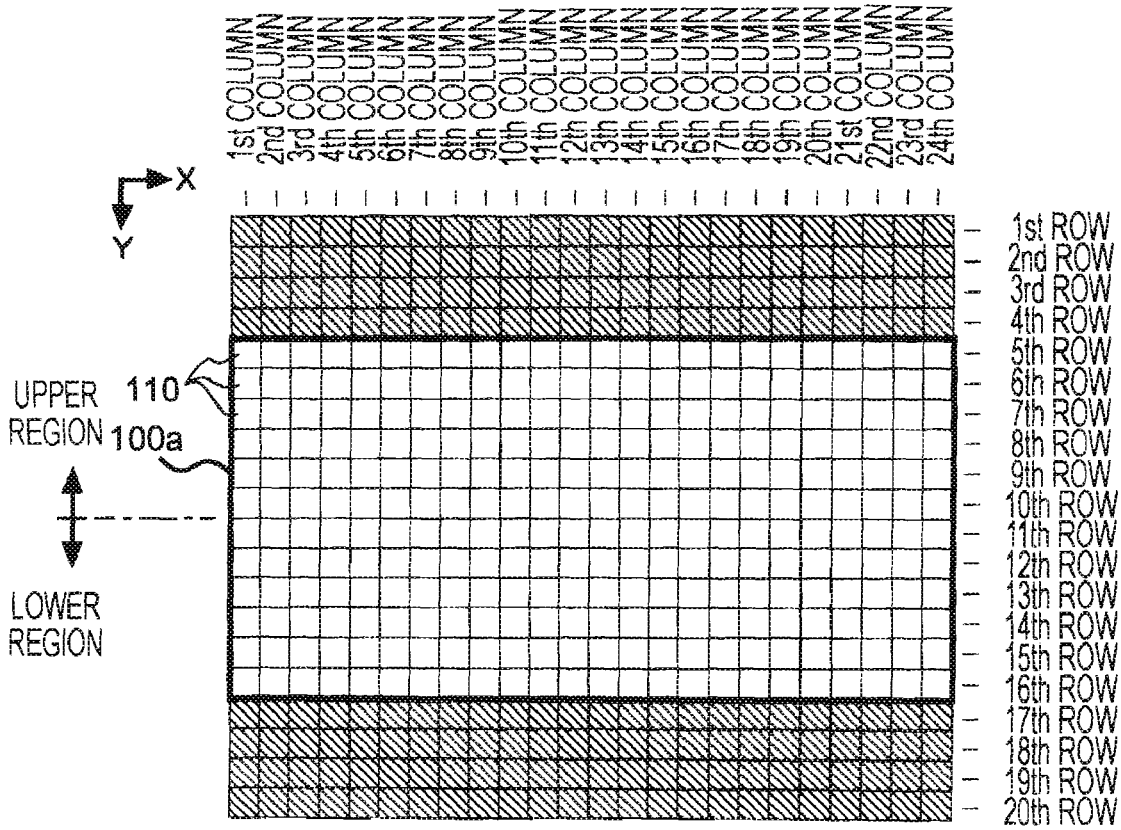
FIG. 2 illustrates the structure of a display panel in the electro-optical apparatus.

In this embodiment, pixels whose gray scales are specified by the image data Vin are arranged in a matrix of 20 rows and 24 columns, as illustrated in FIG. 2.

Figures 3A, 3B:
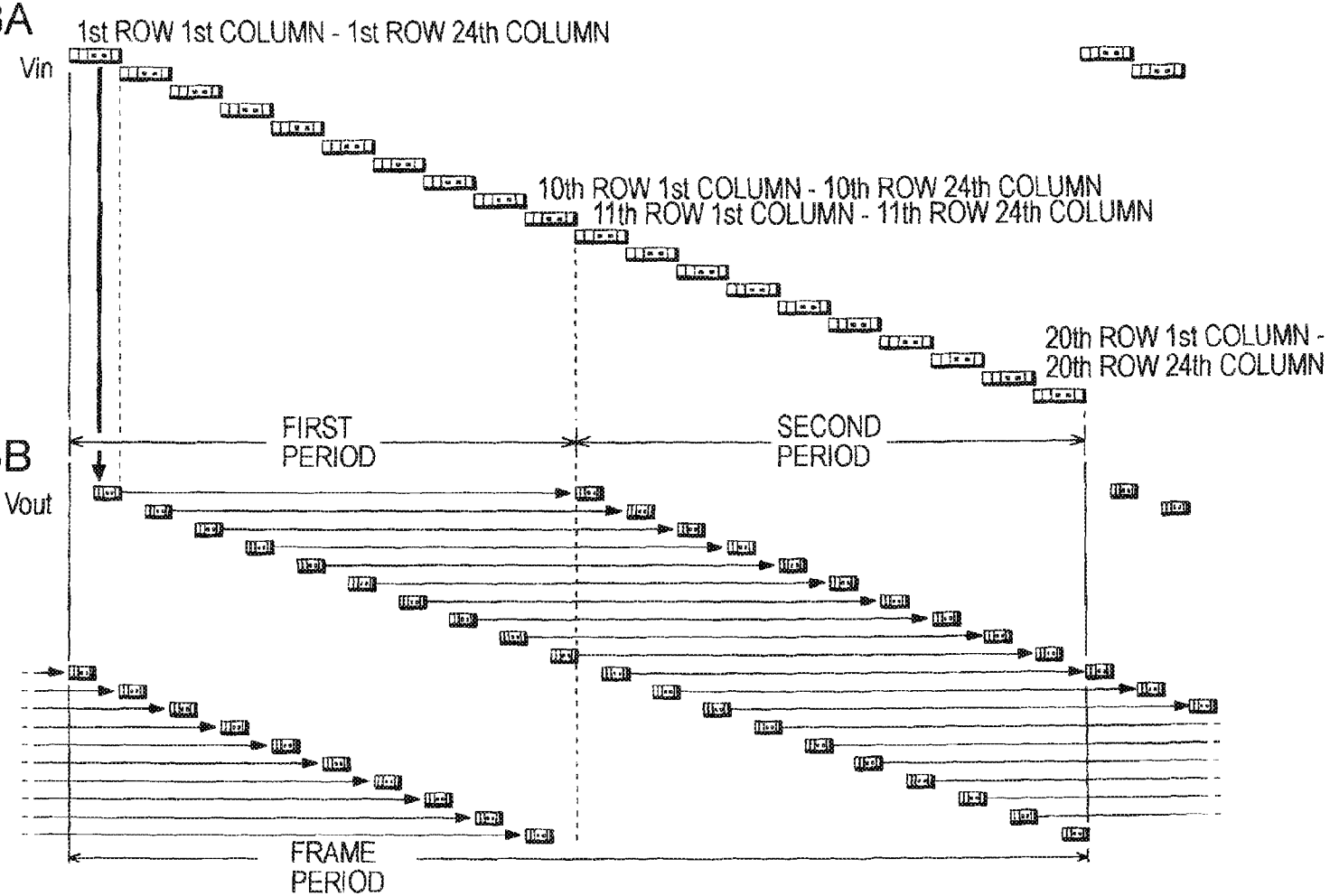
FIGS. 3A and 3B illustrate relationships between image data to the electro-optical apparatus and display regions.

The image data Vin corresponding to each of these pixels is supplied in synchronism with a vertical scan signal Vs, a horizontal scan signal Hs, and a dot clock signal Dclk, as illustrated in FIG. 3A. More specifically, the image data Vin is supplied in order of 1st row and 1st column through 1st row and 24th column, 2nd row and 1st column through 2nd row and 24th column, 3rd row and 1st column through 3rd row and 24th column, . . . , to 20th row and 1st column through 20th row and 24th column over a frame period.

As illustrated in FIG. 3B, the image data Vin supplied in this order is read at a speed twice the storing speed in parallel with a storing operation when data for one half of a single row is stored in the memory 300 and output as the image data Vout. Therefore, the image data Vin for a single row is converted so that the speed is doubled and is output as the image data Vout in the latter half of a period over which the image data Vin for the single row is supplied. In addition, as illustrated in the same figure, image data corresponding to the same pixels as the image data Vout read at doubled speed is read again at doubled speed in the first half of a period over which the image data Vin for a single row after 10 rows is supplied.

Therefore, for example, the image data Vout for the 2nd row is output at doubled speed in each of the latter half of a period over which the image data Vin for the 2nd row is supplied and the first half of a period over which the image data Vin for the 12th row is supplied.

In this embodiment, a period over which the image data Vin for the 1st to 10th rows within a frame period is defined as a first period, and a period over which the image data Vin for the 11th to 20th rows within the frame period is defined as a second period.

Although the image data Vin (Vout) is supplied from 1st to 20th rows, only 5th through 16th rows of pixels, indicated by an area 100*a* surrounded by thick lines in FIG. 2, are actually displayed and the other rows of pixels are dummy and are not displayed. In other words, the image data Vin (Vout) for 1st to 4th rows and 17th to 20th rows is dummy data that specifies black at the lowest level of pixel gray scale.

In this embodiment, for the sake of convenience, an array of pixels is divided along the X direction into two parts, i.e., an upper region (first region) of 1st (5th) to 10th rows and a lower region (second region) of 11th to 20th (15th) rows.

FIG. 1, the S/P conversion circuit 310 distributes the image data Vout read from the memory 300 to six channels while expanding each of the data segments by six times with respect to the time base (called phase expansion (deployment) or also called serial-parallel conversion) and outputs them as image data segments Vd1*d* to Vd6*d*. For the sake of explanation, the image data segments Vd1*d* to Vd6*d* are referred to as channels 1 to 6.

The D/A conversion circuitry 320 is a group of D/A conversion circuits provided for each channel, and converts the image data segments Vd1*d* to Vd6*d* into respective analog signals having voltages according to their respective gray-scale values.

Figure 10:
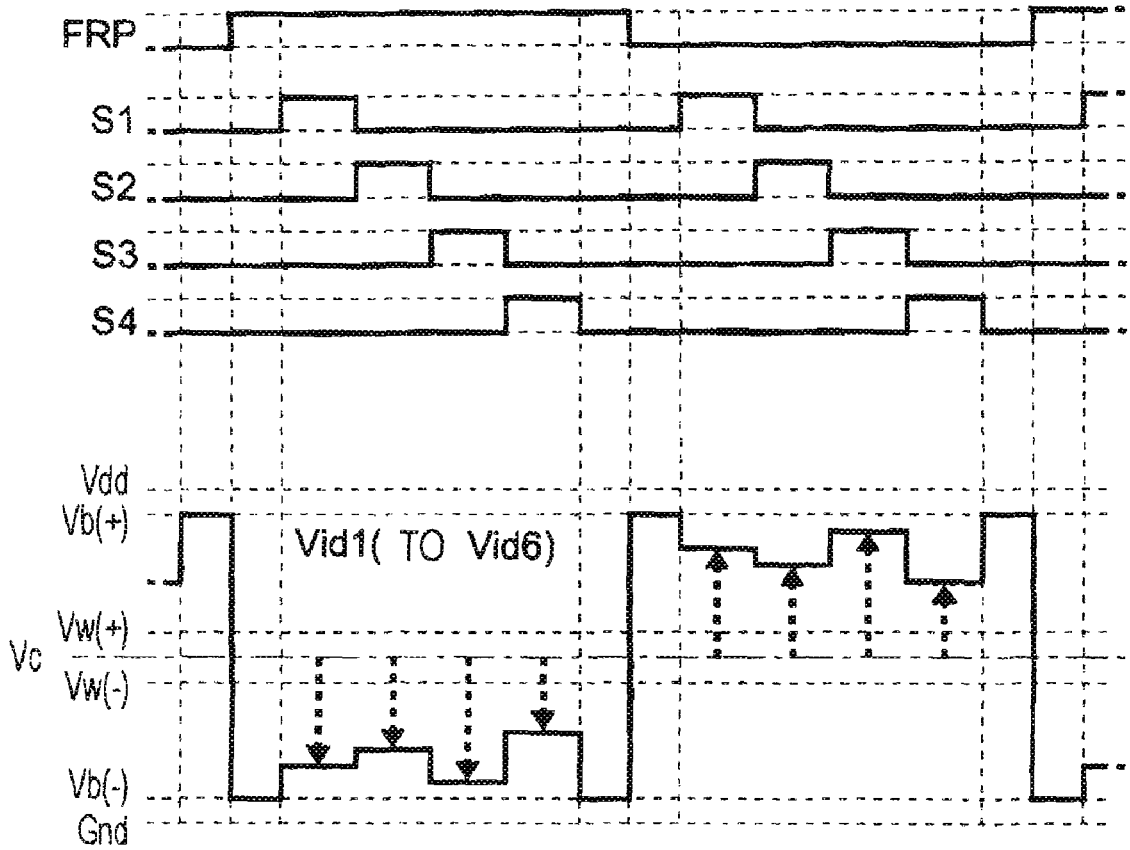
FIG. 10 illustrates voltage waveforms of data signals in the electro-optical apparatus.

The inverter circuit 330 inverts or non-inverts the converted analog signals relative to a voltage Vc, which will be described below, and outputs them as data signals Vid1*a* to Vid6*a*. The voltage Vc is an amplitude reference (center) of data signals, as illustrated in FIG. 10, which will be described below. In this embodiment, for the sake of convenience, as for the data signals Vid1*a* to Vid6*a*, a side higher than the voltage Vc is called positive polarity, and a side lower than the voltage Vc is called negative polarity.

The amplifier circuitry 340 is a group of voltage amplification circuits 342 provided for each channel. The voltage amplification circuits 342 amplify the voltages of the inverted or non-inverted data signals Vid1*a* to Vid6*a* relative to the voltage Vc for each of the positive and negative polarities by set voltage amplification factors, respectively, and supply them to image signal lines of the display panel 100 as data signals Vid1 to Vid6 respectively.

Figure 4:
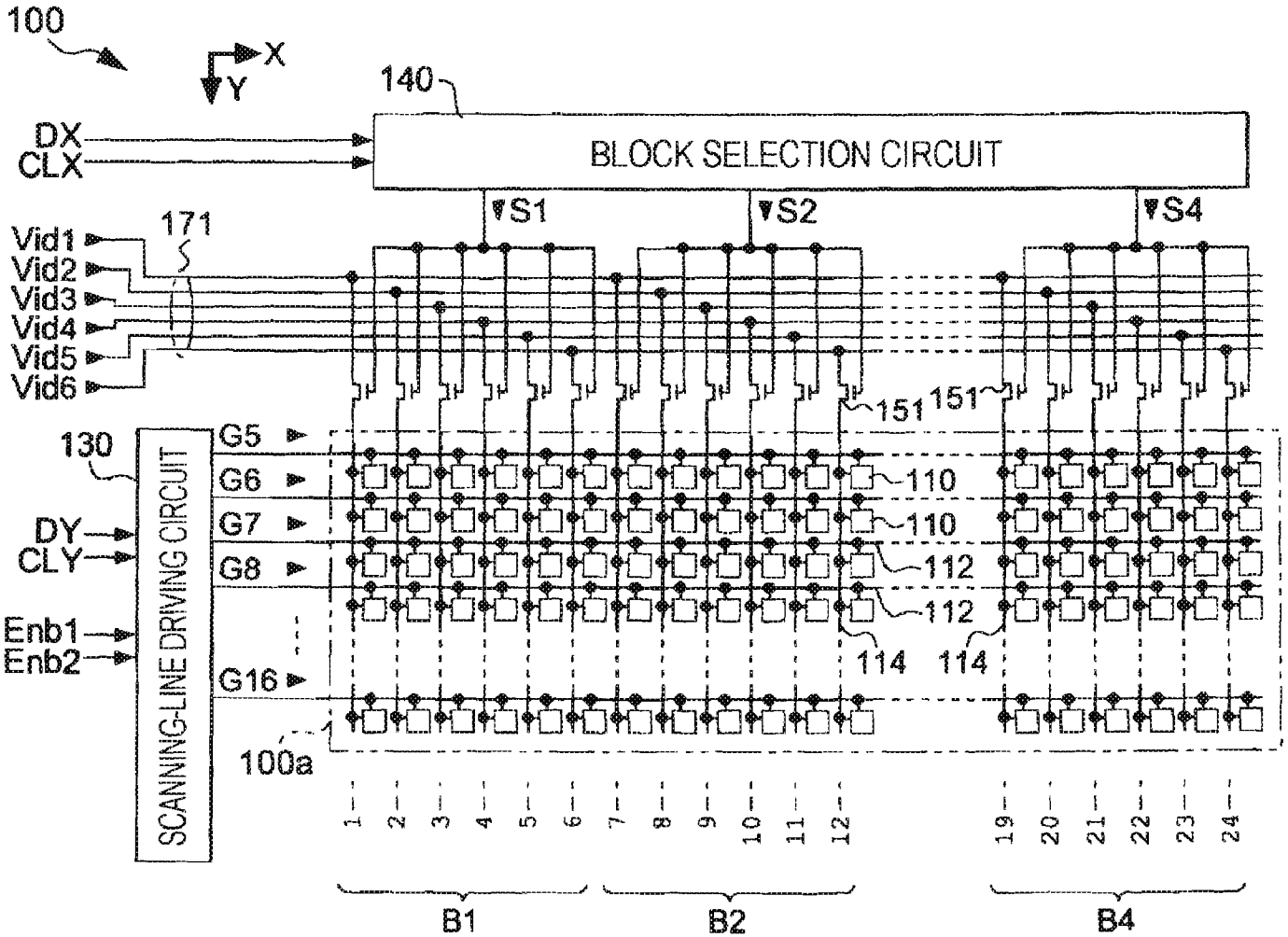
FIG. 4 illustrates the structure of pixels of the display panel.
Figure 5:
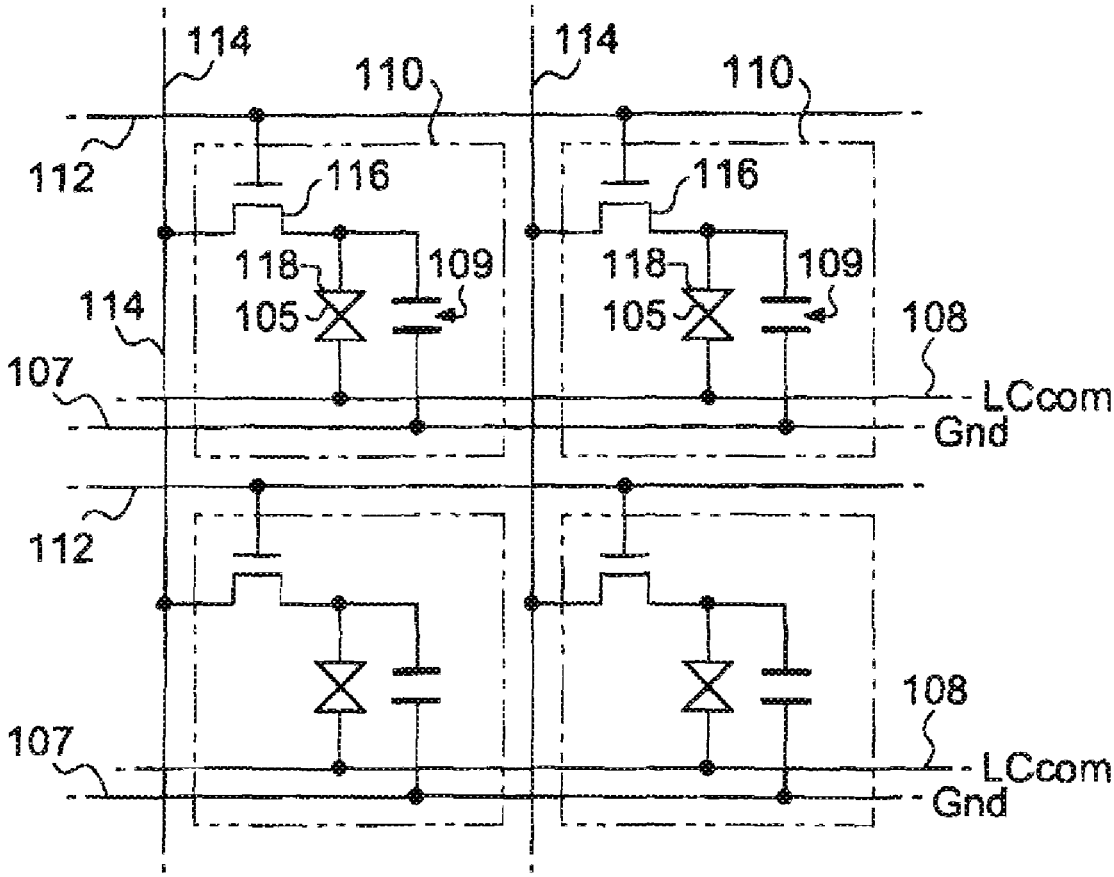
FIG. 5 illustrates image data input to and output from a memory in the electro-optical apparatus.

Next, for the sake of convenience, the structure of the display panel 100 for forming images by electro-optical changes is described. The display panel 100 has a structure in which an element substrate on which data lines, scanning lines, thin-film transistors (TFTs), and pixel electrodes are formed and an opposite substrate on which a common electrode is formed are bonded together with a fixed gap filled with liquid crystal therebetween so that their respective faces on which electrodes are formed are opposed to each other. FIG. 4 is a block diagram showing an electrical structure of the display panel 100. FIG. 5 illustrates the structure of pixels of the display panel 100.

As illustrated in FIG. 4, for the display panel 100, 12 rows of scanning lines 112 for 5th through 16th rows corresponding to the area 100*a*, which is actually displayed, extend in the X direction horizontally) in the figure, whereas 24 (=6×4) columns of data lines 114 extend in the Y direction (vertically) in the figure. Pixels 110 are disposed so as to correspond to intersections of the scanning lines 112 and the data lines 114.

As described above, an array of pixels is divided to two parts. Therefore, in the area 100*a*, the scanning lines 112 for the 5th through 10th rows (scanning lines 112 for the 1st to 6th rows counting from the top in FIG. 4) belong to the upper region. In the area 100*a*, the scanning lines 112 for the 11th through 16th rows (scanning lines 112 For the 7th to 12th rows counting from the top in FIG. 4) belong to the lower region.

In this embodiment, the data lines 114 for 24 columns are classified into four blocks for every six columns. For the sake of explanation, counting from the left, 1st, 2nd, 3rd, and 4th blocks are labeled B1, B2, B3, and B4, respectively.

As illustrated in FIG. 5, for a detailed structure of each of the pixels 110, a source of an n-channel TFT 116 is connected to a data line 114, a drain of the TFT 116 is connected to a pixel electrode 118, and a gate of the TFT 116 is connected to a scanning line 112.

A common electrode 108 is disposed so as to face the pixel electrodes 118 and is common to all pixels. The common electrode 108 is maintained at a voltage LCcom which is constant in term of time. A liquid-crystal layer 105 is sandwiched between the common electrode 108 and the pixel electrodes 118. For each pixel, the pixel electrode 118, the common electrode 108, and the liquid-crystal layer 105 constitutes a liquid crystal capacitor.

In this embodiment, the voltage LCcom applied to the common electrode 108 is the same as the amplitude-reference voltage Vc for data signals. However, both voltages may differ from each other for reasons explained below.

Although not shown in particular, a rubbed alignment layer is disposed on an opposing face of each of both substrates so that the longitudinal axes of liquid crystal molecules are continuously twisted, for example, about 90 degrees between the both substrates and a polarizer corresponding to an alignment direction is disposed on a back-side face of each of the both substrates.

If an effective value of a voltage applied to the liquid-crystal capacitor is zero, light passing through a gap between the pixel electrodes 118 and the common electrode 108 is optically rotated along the twist of the liquid crystal molecules about 90 degrees. As the effective voltage value increases, the liquid crystal molecules become inclined in the direction of an electrical field, and as a result, the optical rotation becomes lost. Therefore, for a transmissive display, for example, when polarizers having the orthogonal polarization axes corresponding to the respective alignment directions are disposed on an incident side and a rear side, respectively, if the effective voltage value is close to zero, the transmittance of light is maximum and white display appears; if the effective voltage value increases, the amount of transmitted light decreases, and the transmittance becomes minimum and black display appears (normally white mode).

In order to reduce adverse effects of a charge leak from the liquid-crystal capacitor via the TFT 116, a storage capacitor 109 is provided for each pixel. A first end of the storage capacitor 109 is connected to the pixel electrode 118 (the drain of the TFT 116). A second end of the storage capacitor 109 is commonly connected to a capacitor line 107 over all pixels and is commonly ground at an electric potential Gnd being a voltage reference at, for example, a low side of a power source.

Around the pixel area 100*a*, peripheral circuits, such as a scanning-line driving circuit 130 and a block selection circuit 140, are disposed.

Although the details will be described later, the scanning-line driving circuit 130 supplies scan signals G5, G6, G7, G8, . . . , and G16 to the scanning lines 112 for the 5th, 6th, 7th, 8th, . . . , and 16th rows, respectively. The block selection circuit 140 outputs sampling signals S1, S2, S3, and S4 for sequentially selecting the blocks B1, B2, B3, and B4, respectively.

A TFT 151 functions as a sampling switch and is provided for each of the data lines 114. A drain of the TFT 151 is connected to one end of a corresponding data line. For six TFTs 151 corresponding to the data lines 114 belonging to a single block, a sampling signal corresponding to the block is commonly supplied to the gates thereof. For example, for six TFTs 151 corresponding to the data lines 114 for the 7th to 12th rows belonging to the block B2, the sampling signal S2 corresponding to the block B2 is commonly supplied to the gates of the six TFTs 151.

In The display panel 100, the data signals Vid1 to Vid6 from the processing circuit 50 are supplied to six image signal lines 171. The six image signal lines 171 are connected to the sources of the TFTs 151 as described below.

For a TFT 151 whose drain is connected to one end of the data line 114 for the j-th column counting from the left in FIG.

4, if the remainder of the division of j by 6 is 1, the source of the TFT 151 is connected to an image signal line 171 to which the data signal VId1 is supplied. Similarly, the sources of TFTs 151 whose drains are connected to the data line for the j-th column having a remainder of 2 of the division of j by 6, that having a remainder of 3, that having a remainder of 4, that having a remainder of 5, and that having a remainder of 6 are connected to image signal lines 171 to which the data signals Vid2, Vid3, Vid4, Vid5, and Vid6 are supplied, respectively.

For example, in FIG. 4, the source of a TFT 151 whose drain is connected to the data line 114 for the 11th column is connected to a image signal line 171 to which the data signal Vid5 is supplied because the remainder of the division of 11 by 6 is 5. Here, j is a mark used to generally describe the data lines 114 when the column number is not specified, and, in this embodiment, j is an integer that satisfies $1 \leqq j \leqq 24$.

Referring back to FIG. 1, the main control performed by the scan control circuit 52 is described below. First, the scan control circuit 52 controls storing (writing) and reading to and from the memory 300 on the basis of the dot clock signal Dclk, the vertical scan signal Vs, and the horizontal scan signal Hs (the waveforms of these signals are not shown) supplied from the host system. Second, the scan control circuit 52 controls a phase expansion in the S/P conversion circuit 310 described above in synchronism with a reading from the memory 300. Third, the scan control circuit 52 generates a transfer start pulse DX and a clock signal CLX and controls a horizontal scan performed by the block selection circuit 140 in synchronism with the reading, and generates a transfer start pulse DY, a clock signal CLY, and enable signals Enb1 and Enb2 and controls a horizontal scan performed by the scanning-line driving circuit 130. Fourth, the scan control circuit 52 specifies, to the inverter circuit 330; negative-polarity writing for a reading of image data Vout for the 11th to 20th rows in the first period, positive-polarity writing for a reading of image data Vout for the 1st to 10th rows in the first period, negative-polarity writing for a reading of image data Vout for the 1st to 10th rows in the second period, and positive-polarity writing for a reading of image data Vout for the 11th to 20th rows in the second period.

A detection circuit (DET) 60 outputs a signal Me at H level, the signal Me indicating permission for voltage monitoring operation, when the transfer start pulses DX and DY and the enable signal Enb1 satisfy a predetermined condition, which will be described later.

Voltage measuring circuitry 70 is a group of voltage measuring circuits (MONs) 72 provided for each channel. The voltage measuring circuits 72 measure the voltages of the respective data signals Vid1 to Vid6 in the respective channels when the signal Me reaches the H level and change the voltage amplification factors of the respective voltage amplification circuits 342 in the respective channels so that the measured voltages are at target voltages.

The detailed operations of the detection circuit 60 and the voltage measuring circuitry 70 will be described later.

The structure of the scanning-line driving circuit 130 is described below with reference to FIG. 6.

Figure 6:
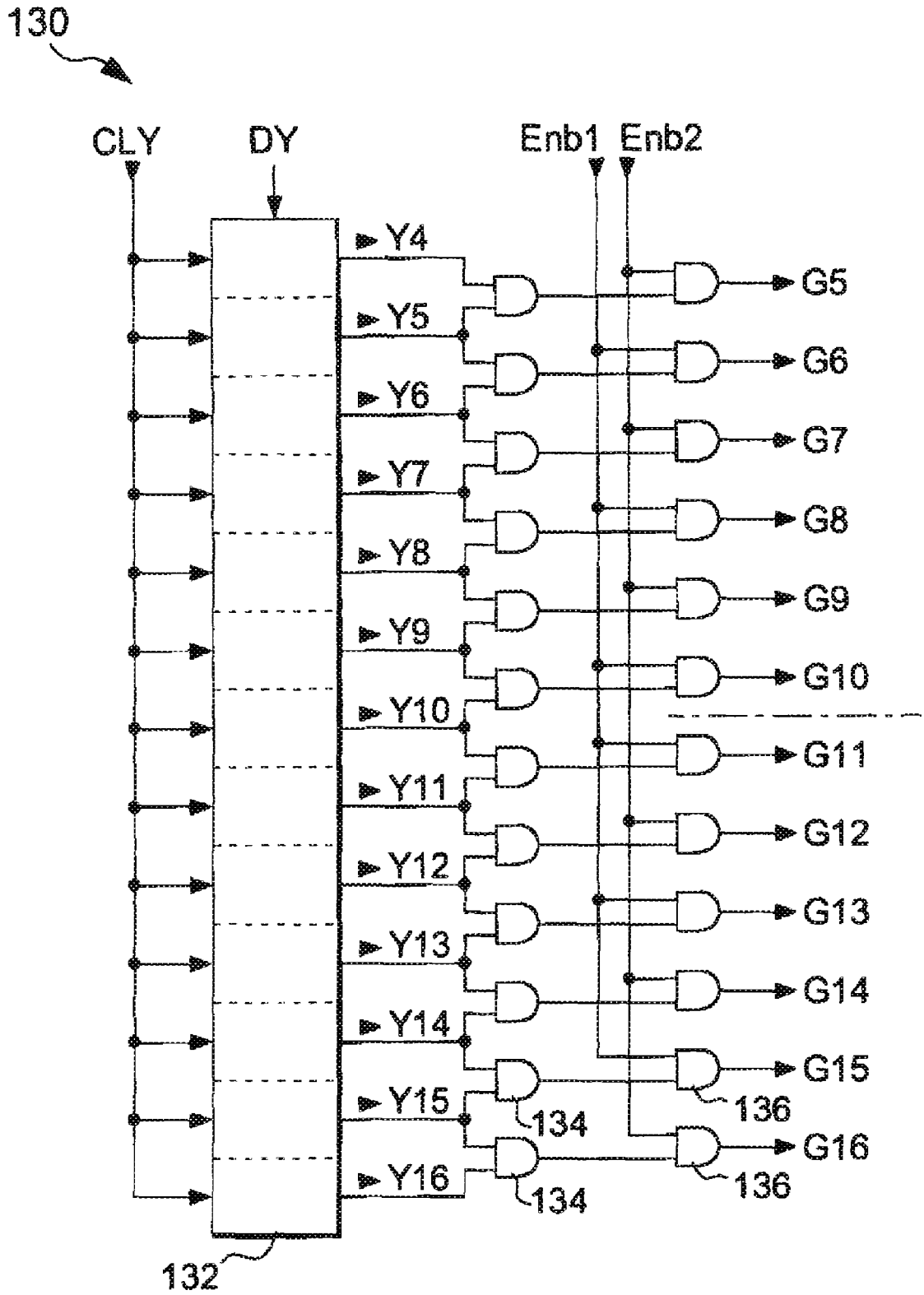
FIG. 6 illustrates the structure of a scanning-line driving circuit in the electro-optical apparatus.

In FIG. 6, a shift register 132 sequentially shifts the transfer start pulse DY every time the logic level of the clock signal CLY varies (rises and falls) and outputs shift signals Y4, Y5, Y6, Y7, . . . , and Y16.

AND circuits 134 output AND signals of the adjacent shift signals. AND circuits 136 output AND signals of the output signals (AND signals) output from the AND circuits 134 and either one of the enable signals Enb1 and Enb2.

The output from an AND circuit 136 that receives the AND signal of the shift signals Y4 and Y5 from the shift register 132 is a scan signal G5. Similarly, the AND signals of the shift signals Y5 and Y6, Y6 and Y7, . . . , Y14 and Y15, and Y15 and Y16 correspond to scan signals G6, G7, . . . , GI5, and G16 output from the ANTD circuits 136, respectively. The scan signals G5, G6, G7, . . . , G15, and G16 are supplied to the scanning lines 112 for the 5th, 6th, 7th, . . . , 15th, and 16th rows.

The relationship between the AND circuits 136 and the enable signals Enb1 and Enb2 is described below. Specifically, in the upper region, AND circuits 136 that supply the scan signals to the scanning lines 112 for odd numbers 5th, 7th, and 9th rows receive the enable signal Enb2, and AND circuits 136 that supply the scan signals to the scanning lines 112 for even numbers 6th, 8th, and 10th rows receive the enable signal Enb1. In the lower region, AND circuits 136 that supply the scan signals to the scanning lines 112 for odd numbers 11th, 13th, and 15th rows receive the enable signal Enb1, and AND circuits 136 that supply the scan signals to the scanning lines 112 for even numbers 12th, 14th, and 16th rows receive the enable signal Eb2. In other words, a supply of the enable signals Enb1 and Enb2 to the AND circuits 136 in the upper region is symmetrical to that in the lower region.

Figure 8:
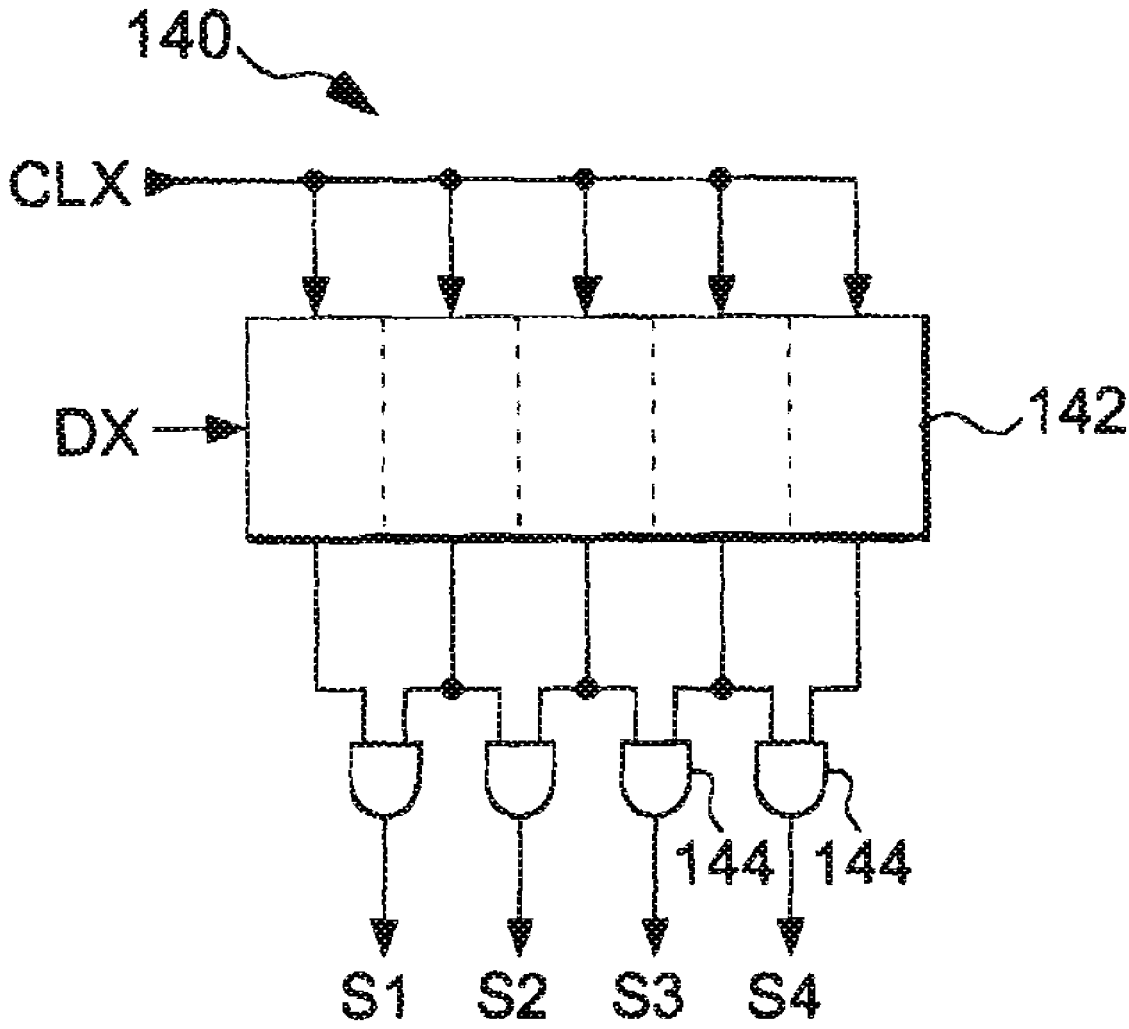
FIG. 8 illustrates the structure of a block selection circuit in the electro-optical apparatus.

As illustrated in FIG. 8, the structure of the block selection circuit 140 is basically the same as that of the scanning-line driving circuit 130. The block selection circuit 140 includes a shift register 142 and AND circuits 144. The block selection circuit 140 differs from the shift register 132 and the AND circuits 134 in the scanning-line driving circuit 130 in that control signals supplied from the scan control circuit 52 are different and in that the numbers of stages of the shift registers are different.

More specifically, in the block selection circuit 140, the shift register 142 receives the transfer start pulse DX and the clock signal CLX in place of the transfer start pulse DY and the clock signal CLY supplied to the scanning-line driving circuit 130. The shift register 142 has five stages, and AND signals of the adjacent shift signals are output as the sampling signals S1, S2, S3, and S4.

Next the operation of the electro-optical apparatus is described.

As illustrated in FIG. 3A, over the frame period, the image data Vin is supplied in order of 1st row and 1st column through 1st row and 24th column, 2nd row and 1st column through 2nd row and 24th column, 3rd row and 1st column through 3rd row and 24th column, . . . , to 20th row and 1st column through 20th row and 24th column.

Figure 11:
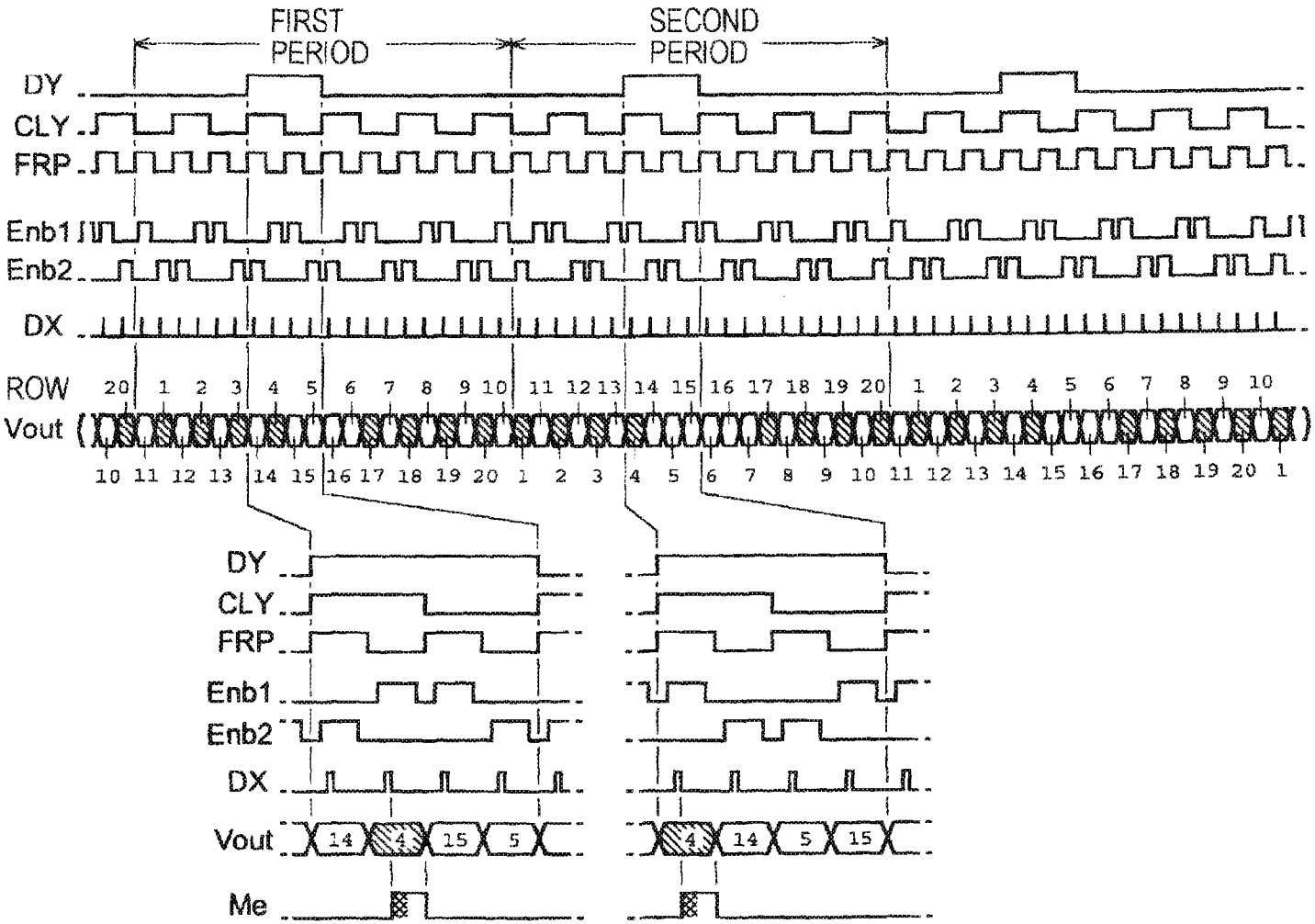
FIG. 11 is a timing diagram of monitoring voltages in the electro-optical apparatus.

As illustrated in FIG. 3B, the image data Vin is output as the image data Vout by the writing and reading to and from the memory 300. As illustrated in FIGS. 3B and 11, in the first period of the frame period, the lower region precedes the upper region, i.e., data is output in order of 11th, 1st, 12th, 2nd, 13th, 3rd, 14th, 4th, . . . , 20th, to 10th rows. In contrast to this, in the second period, the upper region precedes the lower region, i.e., data is output is read and output in order of 1st, 11th, 2nd, 12th, 3rd, 13th, 4th, 14th, . . . , 10th, to 20th rows.

As illustrated in FIG. 11, the scan control circuit 52 sets the logic level of the clock signal CLY at L level in a period over which the image data Vout for 11th and 1st rows is read in the first period and perform inversion every time the image data Vout for two rows is read. In addition, as illustrated in the same figure, the scan control circuit 52 sets the pulse width (H level) of the transfer start pulse DY at one period of the clock signal CLY and sets the timing for starting supplying it at the timing for starting reading the image data Vout for 14th row in the first period and at the timing for starting reading the image data Vout for 4th row in the second period.

Therefore, in the first period, the transfer start pulse DY is at the H level in a period over which the image data Vout for 14th, 4th, 15th, and 5th rows is read. In the second period, the transfer start pulse DY is at the H level in a period over which the image data Vout for 4th, 14th, 5th, and 15th rows is read. The transfer start pulse DY is output for every 5 periods of the clock signal CLY.

Figure 7:
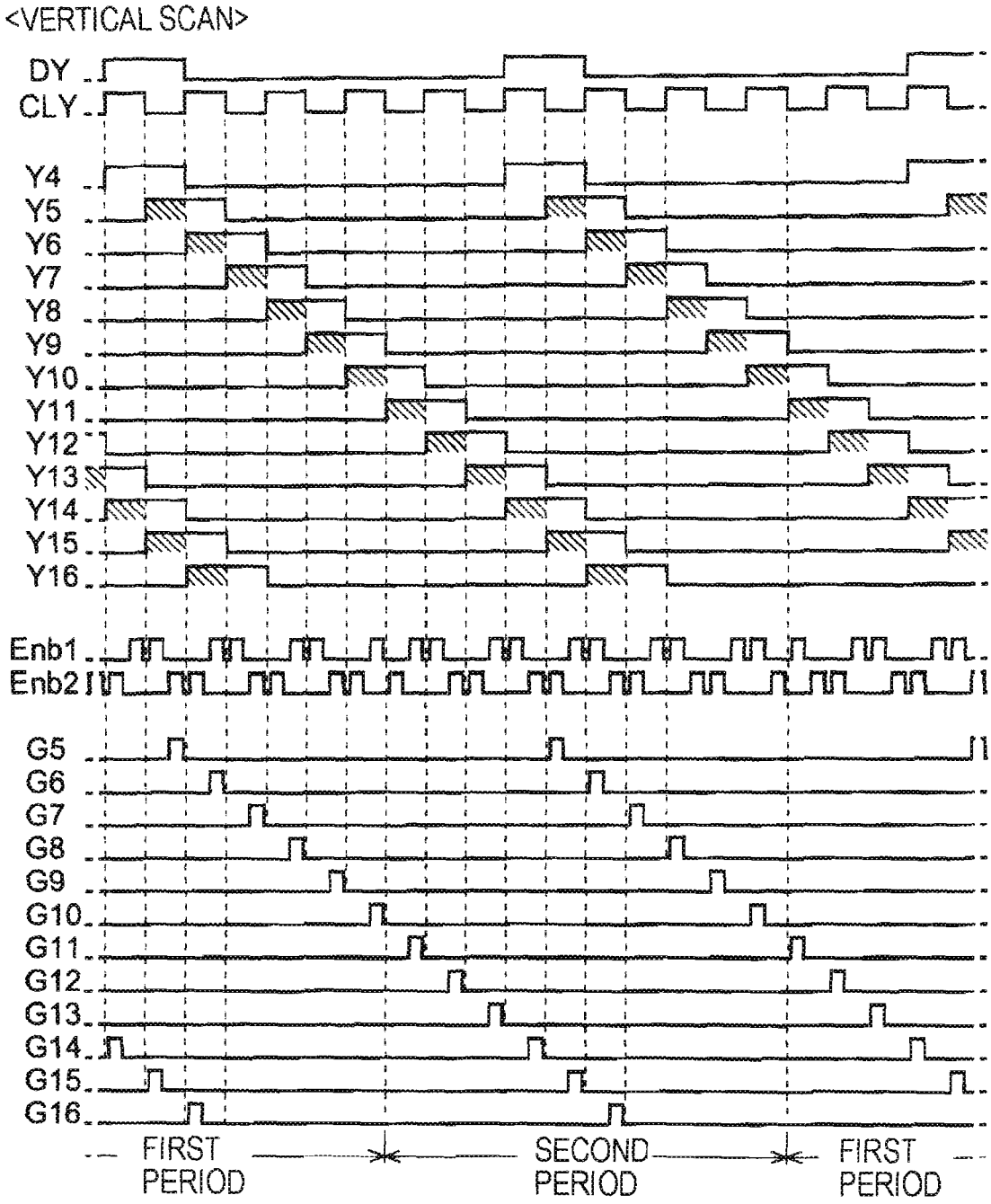
FIG. 7 illustrates an operation of the scanning-line driving circuit.

When these transfer start pulse DY and clock signal CLY are supplied to the scanning-line driving circuit 130, the shift signal Y4 from the shift register 132 has substantially the same waveform as that of the transfer start pulse DY, as illustrated in FIG. 7. Subsequently, the shift signals Y5, Y6, Y7, . . . , and Y16 are sequentially shifted from the transfer start pulse DY (shift signal Y4) by one-half the period of the clock signal CLY. Therefore, the AND signals of the adjacent shift signals determined by the AND circuits 134 are hatched areas for the shift signals in FIG. 7 and are overlapping portions for corresponding stages and their previous stages.

Since the transfer start pulse DY is output for every 5 periods of the clock signal CLY, as previously described, the shift signals Y4 and Y14 are at the H level simultaneously. Similarly, the shift signals Y5 and Y15 are at the H. level simultaneously, and shift signals Y6 and Y16 are at the H level simultaneously.

The scan control circuit 52 outputs the enable signals Enb1 and Enb2 described below, in synchronism with the writing and reading to and from the memory 300. That is, as illustrated in FIGS. 7 and 11, the scan control circuit 52 outputs as the enable signal Enb1 in synchronism with the clock signal CLY, where a signal FRP has a frequency of twice the frecuency of the clock signal CLY, in the first period, two pulses, each having a pulse width that is slightly smaller than ¼ of one period of the clock signal CLY (½ of one period of the signal FRP), are output in rapid succession so that the fall timing of the clock signal CLY is inserted between the two pulses and, in the second period, the same two pulses are output in rapid succession so that the rise timing of the clock signal CLY is inserted between the two pulses. In a period over which the logic level of the signal FRP is constant, the scan control circuit 52 outputs one pulse.

The scan control circuit 52 defines a signal whose phase lags 180 degrees behind the enable signal Enb1 as the enable signal Enb2 in the first period. In the second period, the scan control circuit 52 switches the enable signal Enb1 and the enable signal Enb2 in the first period. In other words, the scan control circuit 52 sets the enable signal Enb1 and the enable signal Enb2 in the first period as the enable signal Enbz and the enable signal Enb1 in the second period.

Since the logic level of the clock signal CLY is inverted every time the image data Vout for two rows is read, the logic level of the signal FRP, which has a frequency of twice the frequency of the clock signal CLY, is inverted every time the image data Vout for one row is read.

In the first and second periods, the signal FRP is at the H level at first. Therefore, the signal FRP is at the H level in the first half of a period over which the image data Vin for one row is supplied and is at the L level in the latter half thereof.

When the enable signals Enb1 and Enb2 are supplied to the AND circuits 136 in the scanning-line driving circuit 130, as illustrated in FIG. 7, the pulse widths of the AND signals determined by the AND circuits 134 are reduced by the enable signal Enb1 or Enb2 and output as the scan signals.

Each of the scan signals is described below with reference to the relationship to the enable signals Enb1 and Enb2, shown in FIGS. 7 and 11, the image data Vin, shown in FIG. 3A, and the image data Vout, shown in FIG. 3B. In the first half and latter half of a period over which the image data Vin for the 5th row is supplied from an external device, the scan signals G15 and G5 are at the H level. In the first half and latter half of a period over which the image data Vin for the 6th row is supplied, the scan signals G16 and G6 are at the H level. Since the 17th and subsequent rows have no scanning lines 112, in a period over which the image data Vin for the 7th row is supplied, the scan signal G7 is at the H level only in the latter half thereof. Similarly, in periods over which the image data Vin for the 8th to 14th rows is supplied, the scan signals G8 to G14 are at the H level only in the latter half thereof.

In addition, in the first half and latter half of a period over which the image data Vin for the 15th row is supplied, the scan signals G5 and G15 are at the H level. In the first half and latter half of a period over which the image data Vin for the 16th row is supplied, the scan signals G6 and G16 are at the H level. Since the 17th and subsequent rows have no scanning lines 112, in a period over which the image data Vin for the 17th to 20th rows is supplied, the scan signals G7 to G10 are at the H level only in the first half thereof.

Since the scanning lines 112 for the 1st to 4th rows do not exist, in a period over which the image data Vin for the 1st to 4th rows is supplied, only the scan signals Gll to G14 are at the H level only in the first half thereof.

In other words, with respect to such a supply of scan signals, the scan signals G5, G6, G7, . . . , and G16 sequentially reach the H level at regular intervals so as to proceed from the top to the bottom along the scanning lines 112. In the first period, immediately after the scan signal G15 (G16) in the lower region reaches the H level, the scan signal GS (G6) in the upper region reaches the H level; in the second period, immediately after the scan signal G5 (G6) in the upper region reaches the H level, the scan signal G15 (G16) in the lower region reaches the H level (first case).

In the first period, after the scan signal G6 (G7 to G13) reaches the H level, the downwardly adjacent scan signal G7 (GS to G14) reaches the H level. In the second period, after the scan signal G7 (G8 to G13) reaches the H level, the downwardly adjacent scan signal G8 (G9 G15) reaches the H level (second case).

Here, in the first half of a period over which the image data Vin for the 5th row is supplied from the external device, the image data Vout for the 15th row is read from the memory 300 and the scan signal G15 is at the H level.

Figure 9:
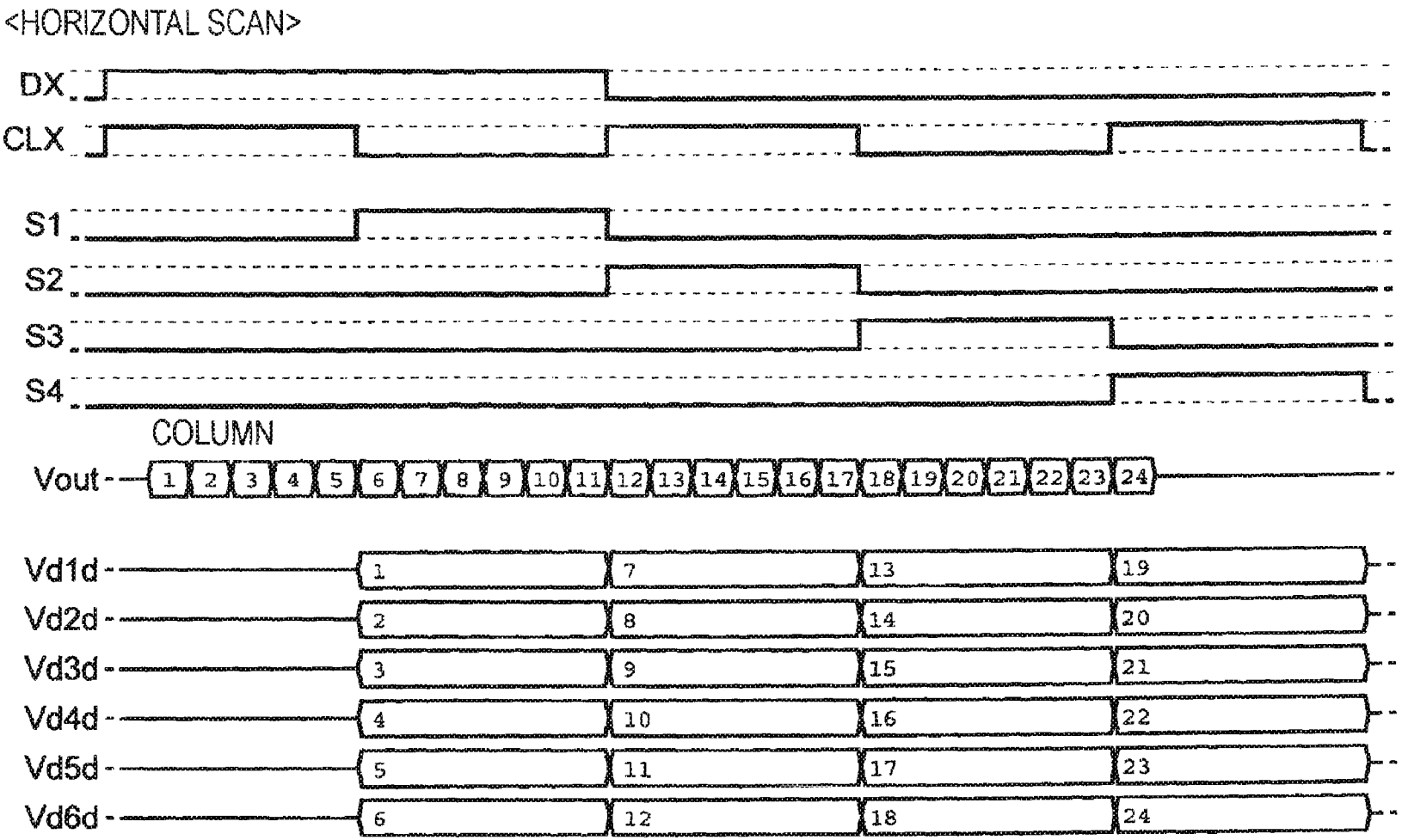
FIG. 9 illustrates a horizontal scan in the electro-optical apparatus.

The image data Vout for the 15th row, more specifically, the image data Vout for the 15th row and 1st column through the 15th row and 24th column is first distributed to the six channels by means of the S/P conversion circuit 310, as illustrated in FIG. 9, and expanded by six times with respect to the time base. Second, the expanded data is converted into analog signals by the D/A conversion circuitry 320. Third, because of the first half of a period over which the image data Vin for one row is supplied in the first period, negative-polarity writing is specified, and therefore, the signals are output as the negative polarity data signals Vid1*a* to Vid6*a* inverted by the inverter circuit 330 relative to the voltage Vc. Fourth, the voltages of the signals Vid1*a* to Vid6*a* are amplified relative to the voltage Vc and output as the data signals Vid1 to Vid6.

As described above, the block selection circuit 140 has basically the same structure as the shift register 132 and the AND circuits 134 (see FIG. 8). Therefore, the sampling signal S1 corresponding to the AND signal is output with a timing that lags one-half the period of the clock signal CLX behind a supply of the transfer start pulse DX. By sequentially shifting the sampling signal S1 by one-half the period of the clock signal CLX, the sampling signals S2, S3, and S4 are obtained.

In order to meet this timing, the scan control circuit 52 causes the S/P conversion circuit 310 to perform phase expansion processing so that one-half the period of the clock signal CLX is equal to a period over which the image data Vout for six pixels is supplied, as illustrated in FIG. 9, and sets the transfer start pulse DX at the H level with a timing advanced by six pixels from a timing of outputting the data signals Vid1 to Vid6 for the 1st to 6th columns and sets the transfer start pulse DX at the L level immediately before the image data Vout for the 12th column is read.

Therefore, in a period over which the data signals Vid1 to Vid6 for the 1st to 6th columns are output, the sampling signal S1 is at the H level. In periods over which the data signals Vid1 to Vid6 for the 7th to 12th columns, 13th to 18th columns, and 19th to 24th columns are output, the sampling signals S2, S3, and S4 are at the H level, respectively.

In a period at which the scan signal G15 is at the H level, when the sampling signal S1 reaches the H level, the data signals Vid1 to Vid6 are sampled into the 1st to 6th data lines 114 belonging to the block B1, which is the first block counting from the left in FIG. 4, respectively. If the scan signal G15 is at the H level, the TFTs 116 in the pixels 110 for one row at the 15th row are all in the ON state. Therefore, the voltages of the data signals Vid1 to Vid6 sampled in the data lines 114 for the six rows are applied to the pixel electrodes 118 of the pixels 110 at the intersections of the scanning line 112 for the 15th column and the data lines 114 for the 1st to 6th columns, show in FIG. 4, respectively.

After that, when the sampling signal S2 reaches the H level, the voltages of the data signals Vid1 to Vid6 are sampled into the data lines 114 for the 7th to 11th columns belonging to the second block B2, respectively. The voltages of the data signals Vid1 to Vid6 are applied to the pixel electrodes 118 of the pixels at the intersections of the scanning line 112 for the i-th row and the data lines 114 for the six columns shown in FIG. 4, respectively.

When the sampling signals S3 and S4 sequentially reach the H level, the voltages of the data signals Vid1 to Vid6 are sampled in the data lines 114 for the six columns belonging to each of the blocks B3 and 54. The data signals Vid1 to Vid6 are applied to the pixel electrodes 118 of the pixels at the intersections of the scanning line 112 for the 15th row and the selected data lines 114 for the six columns, respectively.

Therefore, negative-polarity voltage writing is performed on the pixels for the 15th row and 1st column through 15th row and 24th column. Even if the scan signal G15 reaches the L level and the TFTs 116 are turned off, the written voltages are maintained by the liquid-crystal capacitor and the storage capacitor 109.

In the latter half of a period over which the image data Vin for the 5th row is supplied from the external device, the image data Vout for the 5th row is read from the memory 300 and the scan signal G5 is at the H level.

The basic operation in this case is substantially the same as the first half of the period over which the scan signal G5 is at the H level, except that the image data Vout corresponds to the 5th row and positive-polarity writing is specified because of the latter half of a period over which the image data Vin for one row is supplied in the first period.

In other words in the latter half of the period over which the image data Vin for the 5th row is supplied from the external device, the scan signal G5 is at the H level and positive-polarity writing to the pixels for the 5th row and 1st column through 5th row and 24th column is performed.

For the period over which the image data Vin for the 5th row is supplied, the image data Vout for the 15th row is read in the first half thereof, whereas the image data Vout for the 5th row is read in the latter half thereof. One example of the waveform of the data signal Vid1 in this time is illustrated in FIG. 10.

As described above, the signal FRP is at the H level in the first half of a period over which the image data Vin for one row is supplied and is at the L level in the latter half thereof. In the case of reading the image data Vout for the 11th to 20th rows in the first period, negative-polarity writing is performed; in the case of reading the image data Vout for the 1st to 10th rows in the first period, positive-polarity writing is performed. In the case of reading the mage data Vouut for the 1st to 10th rows in the second period, negative-polarity writing is performed; in the case of reading the image data Vout for the 11th to 20th rows in the second period, positive-polarity writing is performed. That is, in both the first and second periods, the data signal Vid1 has negative polarity when the signal FRP is at the H level and has voltages that are lower than the voltage Vc by voltages specified by the image data Vout (indicated by the down arrows in FIG. 10). In contrast, when the signal FRP is at the L level, the data signal Vid1 has positive polarity and has voltages that are higher than the voltage Vc by voltages specified by the image data Vout (indicated by the up arrows in FIG. 10).

For a period that does not correspond to the image data Vout, the voltage of the data signal Vid1 has a voltage of Vb(+) corresponding to black for positive polarity and has a voltage of Vb(−) corresponding to black for negative polarity.

In FIG. 10, a voltage of Vw(+) is a voltage corresponding to white for positive polarity, and a voltage of Vw(−) is a voltage corresponding to white for negative polarity That is, the data signal Vid1 has a voltage dependent on a grayscale in a range of from Vw(+) to Vb(+) for positive polarity and in a range of from Vb(−) to Vw(−) for negative polarity.

Since the voltage Vc is the amplitude reference of the data signal, voltages Vb(+) and Vw(+) are symmetrical to voltages Vb(−) and Vw(−) with respect to the voltage Vc The data signal Vid1 is described by way of example, and the data signals Vid2 to Vid6 for the other channels have voltages specified by the image data Vout and having positive or negative polarity in a similar manner.

The ground potential Gnd corresponds to L level of a logic signal, such as a sampling signal and a scan signal. A voltage Vdd corresponds to H level of the logic signal.

The operation in a period over which the image data Vin for the 6th row is supplied from the external device is substantially the same as that in the period over which the image data Vin for the 5th row is supplied. In the first half thereof, the image data Vout for the 16th is read from the memory 300, the scan signal G16 is at the H level, and negative-polarity voltage writing is performed on the pixels for the 16th row. In the latter half thereof, the image data Vout for the 6th is read from the memory 300, the scan signal G6 is at the H level, and voltage positive-polarity writing is performed on the pixels for the 6th row.

For a period over wnich the image data Vin for the 7th to 14th rows is supplied, the scan signals G7 to G14 are at the H level only in the latter half thereof and positive-polarity voltage writing is performed on the pixels for the 7th to 14th rows.

For a period over which the image data Vin for the 15th and 16th rows is supplied, in the first half thereof, the image data Vout for the 5th and 6th rows is read from the memory 300, the scan signals G5 and G6 are at the H level, and negative-polarity voltage writing is performed on the pixels for 5th and 6th rows; in the latter half thereof, the image data Vout for the 15th and 16th rows is read from the memory 300, the scan signals G15 and G16 are at the H level, and positive-polarity voltage writing is performed on the pixels for 15th and 16th row.

For a period over which the image data Vin for the 17th to 20th rows is supplied, the scan signals G7 to G10 are at the H level in the first half thereof and negative-polarity voltage writing is performed on the pixels for the 7th to 10th rows.

For a period over which the image data Vin for the 1st to 5th rows is supplied, the scan signals G1 to G5 are at the H level in the latter half thereof and positive-polarity voltage writing is performed on the pixels for the 1st to 5th rows.

According to this driving, when a pixel is focused, In a period from a selection of a scanning line corresponding to the pixel of interest to the next selection, a positive-polarity voltage and a negative-polarity voltage are alternately applied to the data line 114. Therefore, effects on the liquid-crystal capacitor and the storage capacitor of the pixel of interest exerted by the voltage of the data line (in particular a leak of the TFT 116 in the OFF state) have no difference between the upper and lower regions in the display area.

In this embodiment, when a row is selected, the polarity of writing to pixels at the selected row contradict that to pixels at a row that is one above the selected row, but writings to the other pixels have the same polarity. As a result, degradation in the display quality caused by discrimination (alignment defect) can be prevented.

In this embodiment, phase expansion processing in which the image data Vout is distributed to six channels and expanded by six times with respect to the time base is performed. If such phase expansion processing is not performed, there is a possibility that, because a data signal is sampled into a data line per pixel, a sufficient amount of time for supplying the data signal to the data line cannot be obtained and incomplete writing to the pixel is performed.

However, for a structure that performs the phase expansion processing, if, for any reason, a difference of features among channels arises with respect to the data signals Vid1 to Vid6, a difference of the voltages sampled in the data lines 114 arises, even when, for example, display in which all pixels have the same grayscale is to be performed. This causes the pixels to have slightly different grayscales during display, thus degrading the display quality.

In the case where processing that aims to eliminate the difference is performed, a timing for performing the processing is a problem. That is, for region scan driving, the image data Vout is constantly read, and therefore, no simple blanking period is present in vertical scan.

To address the problem, in this embodiment, pixels at the 1st to 4th and 17th to 20th rows are dummy. The image data Vout for the 1st to 4th and 17th to 20th rows is read, but no corresponding scanning lines exist. This allows periods over which the corresponding scanning signals are at the L level to be provided in periods over which all corresponding scanning signals would be at the H level if such dummy pixels do not exist. In this embodiment, the periods can be used as virtual blanking periods.

In one of the first half and the latter half of a period over which the image data Vin for the 1st to 4th and 17th to 20th rows is supplied, the same image data Vout for the 1st to 4th and 17th to 20th rows is read; in the other of the first half and the latter half thereof, the image data Vout spaced 10 rows apart is read and voltage writing is performed. In addition, in the period over which the image data Vin for the 1st to 4th and 17th to 20th rows is supplied, the first half and the latter half of a period over which the image data Vout for the 1st to 4th and 17th to 20th rows is read change places between the first and second periods.

One approach is a structure in which vertical scan signals and horizontal scan signals are counted, the period over which the image data Vin for the 1st to 4th and 17th to 20th rows is supplied is detected, it is determined whether the detected period is in the first period or the second period, and, on the basis of the results, the period over which the image data Vout for the 1st to 4th and 17th to 20th rows is read is identified. However, this structure may have complicated circuitry.

To address this problem, in this embodiments in the period over which the image data Vout for the 1st to 4th and 17th to 20th rows is read, when the transfer start pulses DX and DY and the enable signal Enb1 output from the scan control circuit 52 satisfy a predetermined condition, the processing that aims to eliminate the difference among the channels is performed.

More specifically, the detection circuit 60 receives the transfer start pulses DX and DY and the enable Signal Enb1 and sets the signal Me at the H level in the next period. That is, the detection circuit 60 sets the signal Me at the H level and permits the voltage measuring circuitry 70 to monitor voltages over a period from a timing of a first shot in a period over which the enable signal Enb1 is at the H level and at which the transfer start pulse DX falls to a timing at which the logic level of the signal FRP transitions in a period over which the transfer start pulse DY is output (is at the H level).

It is necessary for the detection circuit 60 to focus on the transfer start pulse DX immediately after the enable signal Enb1 reaches the H level for the first time (a fall) in a period over which the transfer start pulse DY is output. One example of a structure that performs focusing is that the transfer start pulse DX is masked at the fall of the transfer start pulse DX of interest, thereby ignoring the subsequent transfer start pulse DX, and the transfer start pulse DY falls from the H level to the L level, thereby cancelling the masking.

As previously described, in the first period, the transfer start pulse DY is at the H level in a period over which the image data Vout for the 14th, 4th, 15th, and 5th rows is read, and, in this period, a period over which the enable signal Enb1 is at the H level is a period over which the image data Vout for the 4th row is read. A timing at which the transfer start pulse DX falls is provided immediately before the image data Vout for the 12th column is read.

In the second period, the transfer start pulse DY is at the H level in a period over which the image data Vout for the 4th, 14th, 5th, and 15th rows is read, and, in this period, a period over which the enable signal Enb1 is at the H level is a period over which the image data Vout for the 4th row is read. A timing at which the transfer start pulse DX falls is provided immediately after the image data Vout for the 11th column is read.

As a result, in both the first and second periods, the signal Me is at the H level a period from during reading of the dummy image data Voult for the 4th row immediately in front of the rows belonging to the area 100*a* to immediately before the image data Vout for the rows belonging to the area 100*a*.

When the detection circuit 60 causes the signal Me to reach the H level, the voltage measuring circuits 72 for the channels in the voltage measuring circuitry 70 measure the voltages of the data signals for the respective channels and changes the voltage amplification factors for the respective channels in the voltage amplification circuits 342 on the basis of the measured voltages.

Since the image data Vout for the 4th row is dummy, the voltage corresponding to this image data Vout will be a voltage of Vb(+), which corresponds to black for positive polarity, because positive-polarity writing is specified in the first period. Therefore, the target voltage for the channels 1 to 6 in the first period is Vb(+).

Figure 12:
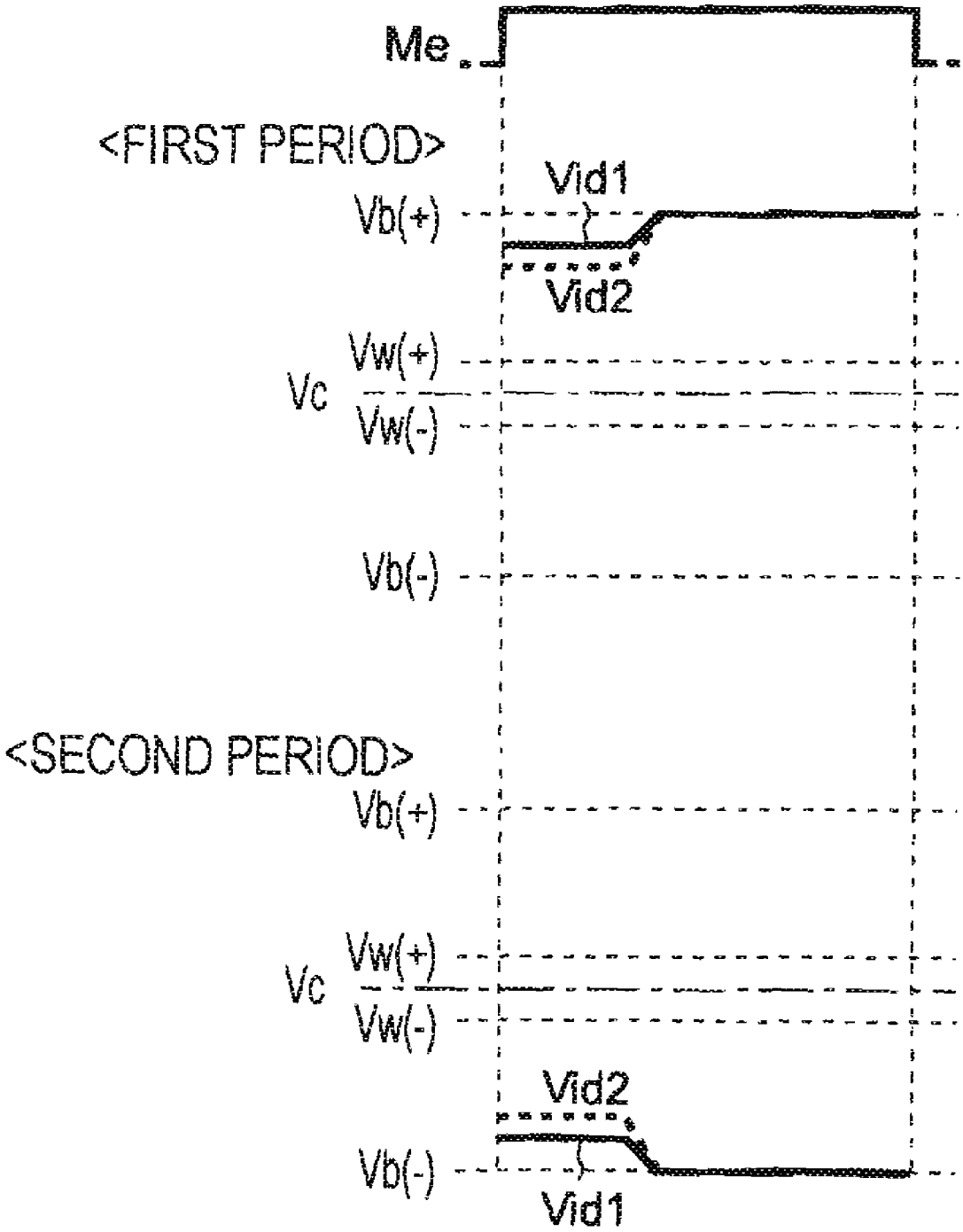
FIG. 12 illustrates a voltage adjustment in the electro-optical apparatus.

For example, if the measured voltage of the data signal Vid1 is displaced from a target voltage of Vb(+), as illustrated in FIG. 12, the voltage measuring circuit 72 corresponding to the channel 1 changes the voltage amplification factor in the voltage amplification circuits 342 so that the voltage of the data signal Vid1 corresponding to the channel 1 is Vb(+). When the voltage of the data signal Vid1 coincides Vb(+), changing the voltage amplification factor in the voltage amplification circuits 342 is completed. For the other channels 2 to 6, similar operations are performed.

In the second period, since negative-polarity writing is specified, the voltage corresponding to the image data Vout for the 4th row is Vb(−), which corresponds to black for negative polarity. That is, in the second period, the target voltage of the channels 1 to 6 is Vb(−), and, when the signal Me reaches the H level, similar operations are performed.

The operation from measuring of voltages to changing of voltage amplification factors is completed in a period that is sufficiently shorter than a period over which the signal Me is at the H level, as indicated by hatched areas in FIG. 11. Therefore, a timing at which the signal Me reaches the H level is important, and a timing at which the signal Me reaches the L level is not so important.

In this embodiment, even when phase expansion processing is performed in region scan driving, a blanking period is virtually generated, and in this period, processing that aims to eliminate a difference of features among the channels is performed. Since a timing of starting the virtual blanking period is provided when the logic levels of the transfer start pulse DX, the transfer start pulse DY, and the enable signal Enb1 used in region scan driving satisfy a predetermined condition, a counter and a structure for determining the counted result are not required. As a result, a simplified structure can be realized.

In the embodiment described above, for the sake of explanation, an array of pixels in the area 10*a* is a matrix of 20 rows and 24 columns and 4 rows from the top and 4 rows from the bottom are dummy. However, other arrangements can be applied.

If a matrix, in particular, an array relating to dummy areas is changed, a period over which the image data Vout for dummy rows may correspond to a period over which the enable signal Enb2 is at the H level. Therefore, it is preferable that the detection the enable signal Enb1 or Enb2 be input to the detection circuit 60 so as to be appropriately switched.

In the embodiment described above, in a part of a period over which the image data Vout for the 4th row is read, the signal Me is at the H level. This structure depends on the relationship between a timing at which the transfer start pulse DY is supplied and a row with which the scan signal reaches the H level for the first time after the transfer start pulse DY is supplied (i.e., the structure of the scanning-line driving circuit 130). Therefore, if it can be identified by using a signal output from the scan control circuit 52, the signal Me may be set at the H level in a period over which the dummy image data Vout for a row other than the 4th row is read.

In the embodiment described above, when the signal Me reaches the H level, the operation from measuring of voltages to changing of voltage amplification factors starts simultaneously for the six channels. However, a timing of performing the operation can be performed sequentially while being shifted for each channel.

In the embodiment described above, the number of phase expansion, m, in the S/P conversion circuit 310 is six, and the number of image signal lines 171 is also six. However, a number of m, which indicates the number of phase expansion and the number of image signal lines, may be any number as long as m is an integer more than one.

In the embodiment described above, the processing circuit 50 performs phase expansion when receiving the digital image data Vin. However, the phase expansion can be performed when receiving an analog image signal. In addition, the embodiment described above uses the normally white mode, which displays white when the effective voltage values of the common electrode 108 and the pixel electrode 118 are small. However, the normally black mode, which displays black in such a condition can be used.

The block selection circuit 140 designates the AND signals of the adjacent shift signals as the sampling signals S1, S2, S3, and S4. However, like the scanning-line driving circuit 130, the pulse widths of the AND signals can be reduced by use of the enable signals.

In the embodiment described above, the voltage LCcom applied to the common electrode 108 is the voltage Vc, which is the same as the amplitude reference of the data signals, as illustrated in FIG. 10.

However, a phenomenon (called "push-down", "punch-through", "field-through", and the like) may occur in which the potential of a drain (pixel electrode 118) decreases when the ON state is switched to the OFF state, resulting from parasitic capacitance between the gate and drain of the TFT 116. In order to avoid degradation of the liquid-crystal layer 105, alternating-current driving is used for the liquid-crystal capacitor in principle. However, if the alternating-current driving is performed when the voltage LCcom and the reference voltage Vc for polarity inversion are the same, the effective voltage of the liquid-crystal capacitor in negative-polarity writing is slightly larger than that in positive-polarity writing due to push-down. If effects from the push-down is not negligible, it is preferable that the voltage LCcom of the common electrode 108 be slightly lower than the reference voltage Vc for polarity inversion so that their effective voltage values of the liquid-crystal capacitor are the same even when positive-polarity writing and negative-polarity writing are performed with the same grayscale.

In the embodiment described above, twisted nematic (TN) liquid crystal is used. However, other liquid crystal types can be used. Examples of the types include the bistable TN (BTN) type, a bistable type having memory features (e.g., ferroelectric type), the polymer dispersed liquid crystal (PDLC) type, and the guest-host (GH) type, in which dye (guest) having anisotropy for absorption of visible light between the longitudinal and transverse directions of molecules is dissolved in liquid crystal (host) having a constant molecular arrangement so that dye molecules are aligned in parallel with the liquid crystal molecules.

In addition, a vertical alignment (homeotropic alignment), in which the liquid crystal molecules are perpendicularly aligned to both substrates while voltages are not applied and the liquid crystal molecules are horizontally aligned to the substrates while voltages are applied, and a parallel (horizontal) alignment (homogeneous alignment), in which the liquid crystal molecules are horizontally aligned to both substrates while voltages are not applied and the liquid crystal molecules are perpendicularly aligned to the substrates while voltages are applied, can be used. The invention can be applied to various structures.

Figure 13:
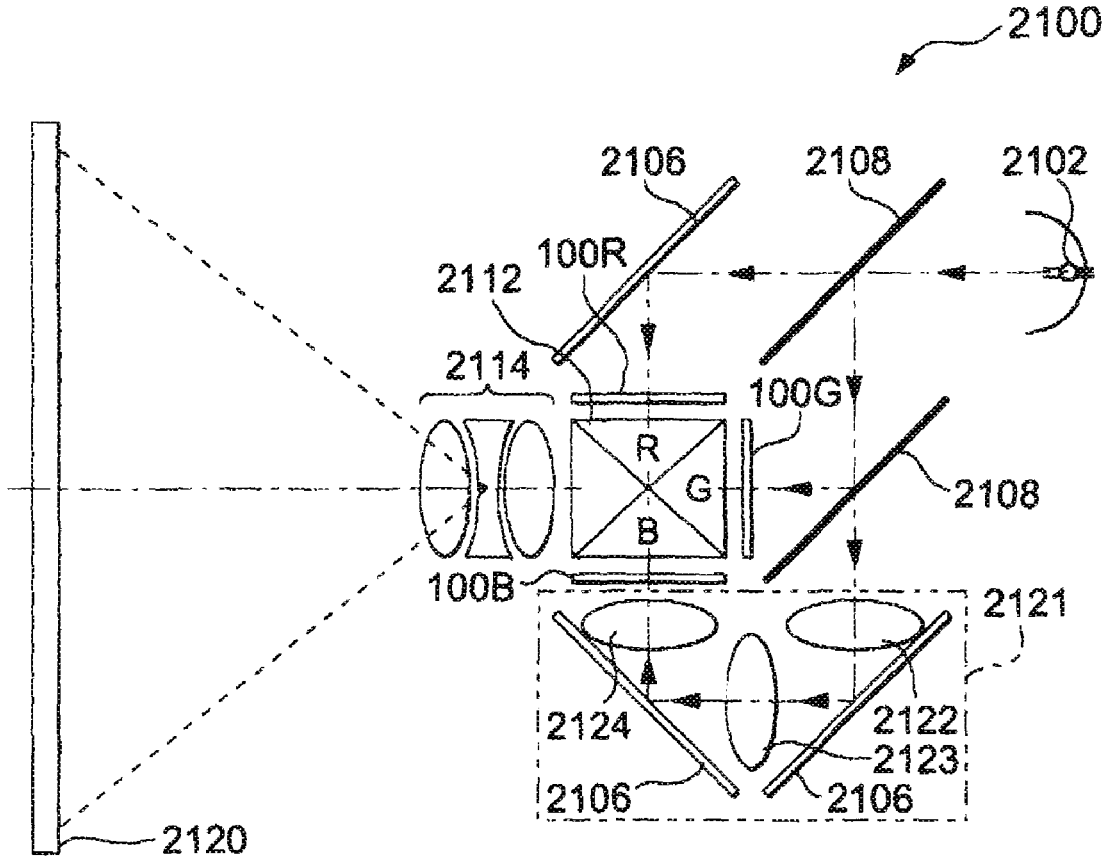
FIG. 13 illustrates the structure of a projector being an example of an electronic device including the electro-optical apparatus.

A projector that uses the display panel 100 described above as a light valve is one example of an electronic device that uses an electro-optical apparatus according to the embodiment described above. The projector is described in greater detail below. FIG. 13 is a perspective view of the projector. As illustrated in FIG. 13, a lamp unit 2102 including a white light source (e.g., a halogen lamp) is disposed inside a projector 2100. Projected light from the lamp unit 2102 is split into three primary colors of red (R), green (G), and blue (B) by three mirrors 2106 and two dichroic mirrors 2108 disposed in the projector 2100, and the split light components are guided into light valves 100R, 100G, and 100B, which correspond to the primary colors, respectively. Since the optical path for the blue light component is longer than that for each of the red and green light components, the blue light components is guided via a relay lens system 2121 including an entrance lens 2122, a relay lens 2123, and an exit lens 2124 in order to reduce losses.

The light valves 100R, 100G, and 100B have a structure that is substantially the same as that of the display panel 100 according to the embodiment described above and are driven by image signals that are supplied from processing circuits (not shown in FIG. 13) and that correspond to their respective colors R, G, and B, respectively. The projector 2100 includes three electro-optical apparatuses corresponding to the colors R, G, and B, each electro-optical apparatus including the display panel 100.

Light components modulated by the light valves 100R, 100G, and 100B enter a dichroic prism 2112 from three directions, respectively. Through the dichroic prism 2112, the red and blue light components are reflected by 90 degrees, whereas the green light component travels in a straight line. As a result, after images of the light components for the colors are combined, a color image is projected on a screen 2120 via a projection lens 2114.

Since the light components corresponding to the colors R, G, and B enter the light valves 100R, 100G, and 100B by means of the dichroic mirrors 2108, respectively, a color filter is not required, as described above. A transmitted image through each of the light valves 100R and 100B is projected after being reflected from the dichroic prism 2112, whereas a transmitted image through the light valve 100G is projected without being reflected. Therefore, the horizontal scan direction in each of the light valves 100R and 100B is opposite to that in the light valve 100G so that the horizontally inverted images are displayed.

An electro-optical apparatus according to the embodiment of the invention can be included in various electronic devices, in addition to the projector described with reference to FIG. 13. Examples of the electronic device include, although not limited to, a television, a viewfinder videotape recorder, a direct-view monitor videotape recorder, a car navigation system, a pager, an electronic organizer, a personal digital assistant, a calculator, a word processor, a workstation, a videophone, a POS terminal, a digital still camera, a mobile phone, and a device including a touch panel.

What is claimed is:

1. An electro-optical apparatus comprising:

a plurality of rows of scanning lines;

a plurality of columns of data lines;

a plurality of pixels disposed so as to correspond to intersections of the plurality of rows of scanning lines and the plurality of columns of data lines, wherein the scanning lines, the data lines, and the pixels are disposed in a pixel area, and the pixel area is virtually divided into at least first and second regions along the scanning lines, a scanning-line driving circuit including a shift register for sequentially shifting a transfer start pulse, the scanning-line driving circuit selecting a scanning line included in one of the first and second regions and then selecting a scanning line included in the other one of the first and second regions;

a block selection circuit for sequentially selecting a block composed of the data lines for m columns (m is an integer that is larger than one and smaller than the number of the data lines) when the scanning line is selected;

a data-signal supplying circuit for supplying to m image signal lines respective data signals having voltages according to grayscales of pixels corresponding to the selected scanning line and the data lines for the m columns belonging to the selected block;

a sampling switch disposed on each of the data lines, the sampling switch sampling the data signals supplied to the m image signal lines into the data lines for the m column belonging to the selected block selected by the block selection circuit; and a voltage measuring circuit having channels, the voltage measuring circuit measuring a voltage of a data signal supplied to at least one of the m image signal lines in a period from a rising of the transfer start pulse to a supply of an image signal corresponding to the scanning line at a first row and changing a voltage amplification factor for the channels on the basis of the measured voltages.

2. The electro-optical apparatus according to claim 1, wherein the voltage measuring circuit adjusts a measured voltage of a data signal supplied from the data-signal supplying circuit so that the measured voltage of the data signal is equal to a predetermined target value.

3. The electro-optical apparatus according to claim 1, further comprising a detection circuit, wherein the scanning-line driving circuit includes:

a shift register for sequentially shifting a transfer start pulse DY with a clock signal CLY; and a logic circuit disposed so as to correspond to each of the plurality of scanning lines, each of the logic circuits receiving either one of first and second enable signals, reducing a pulse width of a shift signal output from the shift register to a pulse width of the received first or second enable signal, and supplying the signal to the corresponding scanning line as a scan signal, wherein the logic circuit for receiving the first enable signal and the logic circuit for receiving the second enable signal are alternately disposed, wherein the block selection circuit includes a shift register for sequentially shifting a transfer start pulse DX with a clock signal CLX, and wherein the detection circuit detects that the transfer start pulse DY, either one of the first and second enable signals, and the transfer start signal DX satisfy a predetermined condition and permits the voltage measuring circuit to measure the voltage.

4. The electro-optical apparatus according to claim 3, wherein the detection circuit detects the predetermined condition in such a way that the transfer start pulse DY and either one of the first and second enable signals are switchable.

5. An electronic device comprising an electro-optical apparatus according to claim 1.

6. An electro-optical apparatus comprising:

a plurality of pixels disposed in a pixel area so as to correspond to intersections of a plurality of rows of scanning lines and a plurality of columns of data lines, the pixels indicating grayscales according to voltages of data signals supplied to the data lines, the pixel area being virtually divided into at least first and second regions along the scanning lines;

a scanning-line driving circuit exclusively selecting the scanning lines at established intervals so that the selection moves toward a predetermined direction, wherein the scanning-line driving circuit selects the scanning lines in different manners for first and second cases; for the first case, after selecting scanning lines in one of the first and second regions, the scanning-line driving circuit selects scanning lines in the other one of the first and second regions; and for the second case, after selecting scanning lines in one regions of the first and second regions, the scanning-line driving circuit selects scanning lines adjacent to the selected scanning lines in the predetermined direction;

a block selection circuit for sequentially selecting a block composed of the data lines for m columns (m is an integer that is larger than one and smaller than the number of the data lines) when the scanning lines are selected;

a data-signal supplying circuit for supplying to m image signal lines respective data signals having voltages according to grayscales of pixels corresponding to the selected scanning lines and the data lines for the m columns belonging to the selected block;

a sampling switch disposed on each of the data lines, the sampling switch sampling the data signals supplied to the m image signal lines into the data lines for the m column belonging to the selected block selected by the block selection circuit; and a voltage measuring circuit having channels, the voltage measuring circuit measuring a voltage of a data signal supplied to at least one of the m image signal lines when none of the plurality of scanning lines is selected in the second case and changing a voltage amplification factor for the channels on the basis of the measured voltages.

7. A method for driving an electro-optical apparatus including a plurality of pixels disposed in a pixel area so as to correspond to intersections of a plurality of rows of scanning lines and a plurality of columns of data lines, the pixels indicating grayscales according to voltages of data signals supplied to the data lines, the pixel area being virtually divided into at least first and second regions along the scanning lines, the method comprising:

selecting a scanning line included in one of the first and second regions and then selecting a scanning line included in the other one of the first and second regions by sequentially shifting a transfer start pulse;

sequentially selecting a block composed of the data lines for m columns (m is an integer that is larger than one and smaller than the number of the data lines) when the scanning line is selected;

supplying to m image signal lines respective data signals having voltages according to grayscales of pixels corresponding to the selected scanning lines and m data lines included in the selected block;

supplying to m image signal lines respective data signals having voltages according to grayscales of pixels corresponding to the selected scanning line and the data lines for the m columns belonging to the selected block;

sampling the data signals supplied to the m image signal lines into the data lines for the m column belonging to the selected block;

measuring a voltage of a data signal supplied to at least one of the m image signal lines in a period from a rising of the transfer start pulse to a supply of an image signal corresponding to the scanning line at a first row; and adjusting a measured voltage of a data signal supplied to the image signal line so that the measured voltage of the data signal is equal to a predetermined target value.

* * * * *